US005630248A

United States Patent [19]

Luca

[11] Patent Number: 5,630,248

[45] Date of Patent: May 20, 1997

[54] DOOR CLOSER WITH SEMI-AUTOMATIC LATCHING

[76] Inventor: Valentin Luca, 125 Katona Dr. #4A6, Fairfield, Conn. 06430

[21] Appl. No.: 547,921

[22] Filed: Oct. 25, 1995

[51] Int. Cl.[6] ..... E05F 1/00; E05F 5/02

[52] U.S. Cl. ..... 16/71; 16/49; 16/66; 16/82; 16/DIG. 10

[58] Field of Search ..... 16/71, 72, 82, 16/84, 85, 49, 66, DIG. 10

[56] References Cited

U.S. PATENT DOCUMENTS

| | | | |
|---|---|---|---|
| 3,105,264 | 10/1963 | Truhon | 16/49 |
| 3,284,841 | 11/1966 | Patriquin | 16/66 |
| 4,194,264 | 3/1980 | Stoffregen | 16/52 |
| 4,382,311 | 5/1983 | Watts | 16/66 |
| 4,815,163 | 3/1989 | Simmons | 16/47 |
| 4,894,883 | 1/1990 | Fleischhauer | 16/66 |
| 4,920,609 | 5/1990 | Lin | 16/66 |
| 5,048,150 | 9/1991 | Gueriu | 16/66 |

*Primary Examiner*—Chuck Y. Mah

[57] ABSTRACT

A door closer employing a cylinder having an end attachable to a door or door frame and slidably retaining a piston biased by a spring to a maximum retracted position in the cylinder. One end of a rod is attached to the piston and the other end extends from the cylinder and is attachable to a door frame or door. Confined to a short longitudinal space in the cylinder and riding on the rod, is a cantable washer. Structural members at the ends of the washer space in the cylinder maintain the washer in an essentially perpendicular orientation on the rod so that it may slide through the washer freely as the door is opened or closed. A positionable support, longitudinally buttressed from the cylinder, is introducible into the washer space so that the support may contact the washer on initiation of retraction of the rod into the cylinder causing the washer to cant, arrest the piston rod, and hold the door open. To unlatch the door, the positionable support is withdrawn to avoid canting contact with the washer. Several embodiments of the invention vary the elements of the positionable support.

13 Claims, 4 Drawing Sheets

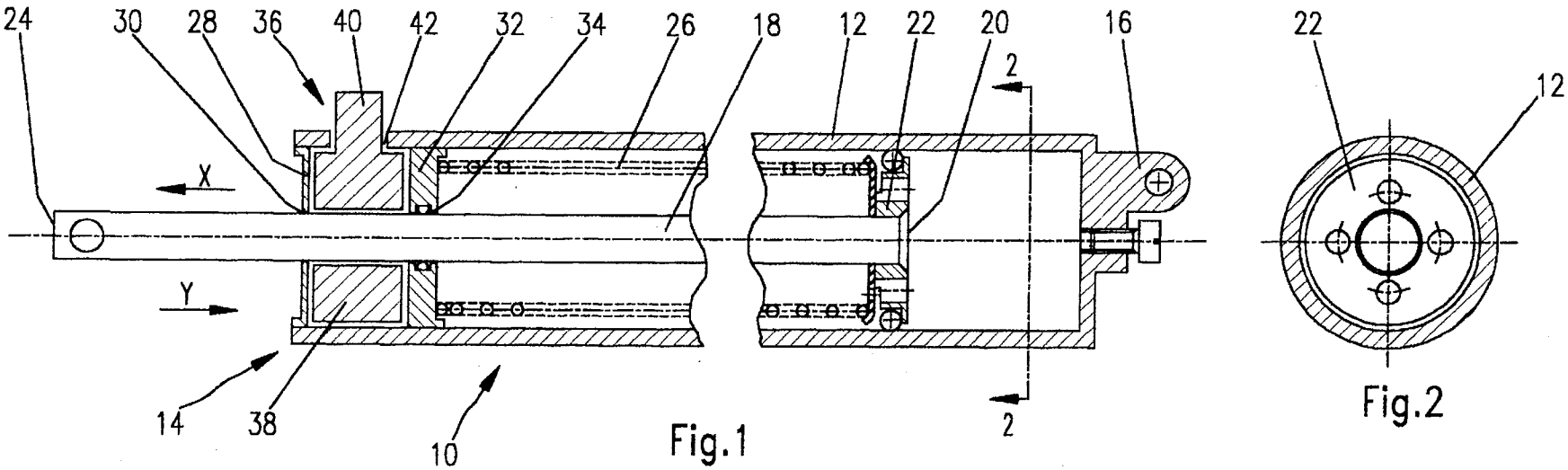
Fig.2
Fig.1
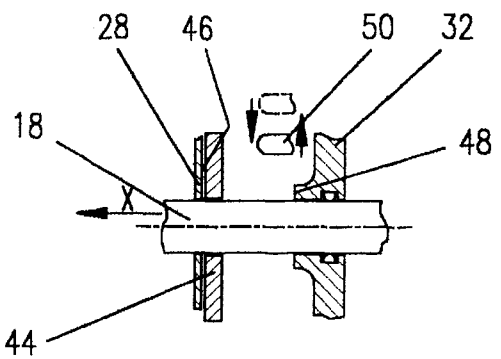
Fig.5
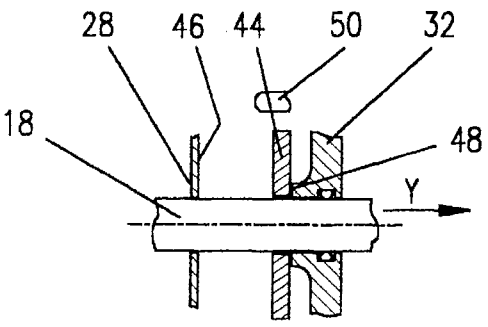
Fig.4
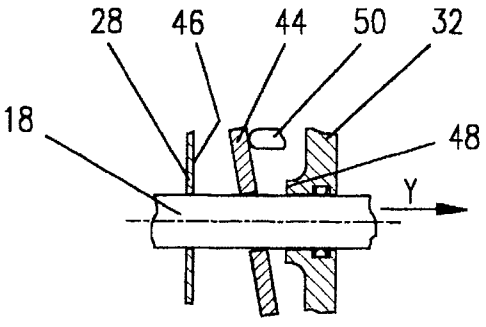
Fig.3

DOOR CLOSER WITH SEMI-AUTOMATIC LATCHING

BACKGROUND

This invention relates to a door closer, more specifically to a door closer with semi-automatic latching to hold a door open.

A door closer is an apparatus to return an opened door to a closed position. Common door closers comprise a cylinder having an end attachable to a door or door frame. The cylinder contains a piston on a rod with an end extending from the free end of the cylinder. The extending end of the rod is attachable to a door frame or door. A spring in the cylinder urges the piston to return to a maximum retracted position in the cylinder.

Usually a manually operated latch such as a cantable washer is mounted on the exposed part of the rod to allow a user to arrest the door temporarily in an open position. Such a latch is not very convenient to a user. Its operation normally requires two hands, one being used to open and hold the door while the other is used to slide the washer on the rod until it contacts a stop provided on the cylinder. Upon release of the door, the stop cants the washer so that it grasps and arrests the rod and the door is held open. To unlatch the door, the user must open the door further to relieve the force on the washer applied by the stop and then slide the washer along the rod to a location where it will not contact the stop for the entire retracting movement of the rod into the cylinder as the door closes.

Door closers with more convenient latches have been proposed in the prior art, but have not gained commercial acceptance. The reasons are that they are considerably more expensive than closers with manual latching as described and each have particular drawbacks peculiar to the mechanism employed. What is needed is a door closer which is inexpensive, reliable, durable and more convenient to latch and unlatch than existing door closers with conventional manually operated latches. This invention satisfies the above needs.

SUMMARY

The invention provides a door closer which employs a cylinder having an end attachable to a door or door frame. Slidably retained in the cylinder is a piston biased by a spring to a maximum retracted position in the cylinder. One end of a rod is attached to the piston and the other end extends from the cylinder and is attachable to a door frame or door. Confined to a short longitudinal space in the cylinder and riding on the rod, is a cantable washer. Structural members at the ends of the washer space in the cylinder maintain the washer in a perpendicular orientation on the rod so that it may slide through the washer freely as the door is opened or closed. A positionable support, longitudinally buttressed from the cylinder, is introducible into the washer space so that the support may contact the washer. Then, an initiation of retraction of the rod into the cylinder causes the washer to cant, arrest the piston rod, and hold the door open. To unlatch the door, the movable support is withdrawn to avoid canting contact with the washer. Thus, unlike conventional door closers employing a cantable washer, the user does not have to slide the washer on the rod to a desired latching position. In the present invention, the washer is intrinsically slid along the rod by the door closer itself until latching is activated.

In one embodiment of the invention, the user may open the door and set the latch simply by turning or pushing or pulling a button or lever which introduces the positionable support. Unlatching, when desired, is similarly performed, which withdraws the support. Such action is called manual latching.

In another embodiment, the latching mechanism sets itself in latching enabled position so that when the door is opened, then released and begins to close, it will latch in the open position without further action by the user. This action is called automatic latching. To unlatch the door, the user must then turn, push or pull a button or lever.

In another embodiment, a user may latch a door in an open position by turning, pushing or pulling a button or lever. To unlatch the arrested door, the user need then only move the door slightly in an opening direction and release it., whereupon it will then close. This action is called automatic unlatching. A door closer which provides either automatic latching or automatic unlatching is called herein a door closer with semi-automatic latching.

DRAWINGS

These and other features, aspects and advantages of the present invention will become better understood with reference to the following description, appended claims, and accompanying drawings where:

FIG. 1 is a longitudinal cross-sectional view through a door closer embodying the invention.

FIG. 2 is a cross-sectional view taken along the line 2—2 of FIG. 1.

FIG. 3 is a schematic illustrating a latching means according to this invention in latching position.

FIG. 4 is a schematic illustrating the latching means in unlatched position during door closing.

FIG. 5 is a schematic illustrating the latching means in unlatched position during door opening.

DESCRIPTION OF THE PREFERRED EMBODIMENTS

Figure 6:
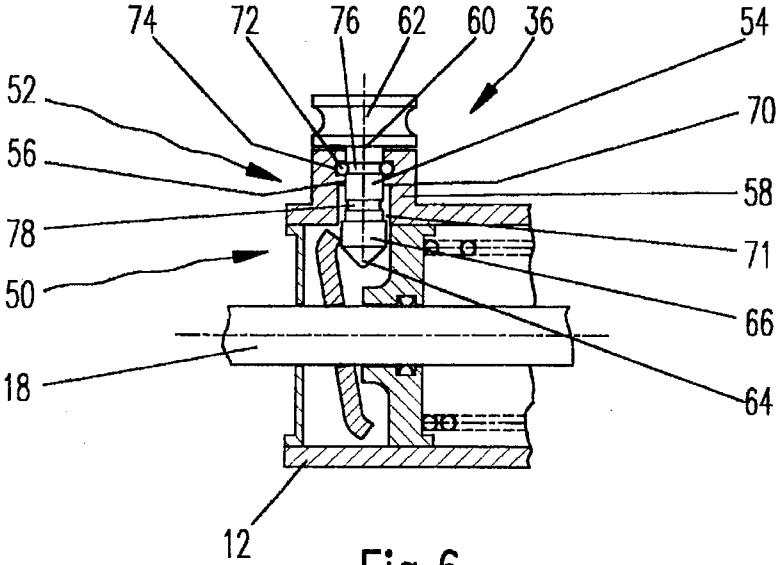
FIG. 6 is a longitudinal cross-sectional view illustrating, in latched position, one embodiment of the invention employing a push-pull button for latching and unlatching.

Examples of presently preferred embodiments of the invention are illustrated in the accompanying drawings. Referring to FIGS. 1 and 2, the door closer 10 provided by this invention has a cylinder 12 having a free end 14 and an attachable end 16 attachable to a door or door frame. Within the cylinder is a piston rod 18 having a piston end 20 retaining a piston 22 and an attachable end 24 attachable to a door frame or door. An arrow X indicates the direction of movement of the rod 18 when the door is opened and the rod extends from the cylinder 12. An arrow Y indicates the direction of movement of the rod 18 when the door is closed and the rod retracts into the cylinder 12. The piston is displaceable within the cylinder from a maximum retracted position to a maximum extended position, not shown. An urging means 26 within the cylinder urges the piston towards the maximum retracted position in the cylinder. A preferred maximum retracted piston position is proximate the attachable end of the cylinder. A preferred urging means is a compression spring around the piston rod. Fixed in the cylinder proximate the free end of the cylinder is an end cap 28 having a passage 30 for the piston rod. Also fixed in the cylinder longitudinally spaced from the end cap is an intermediate support 32. A preferred form of intermediate support 32 is a plate which also serves to support the compression spring at a spring end distal from the piston. The plate has a passage 34 for the piston rod. Between the end cap 28 and the intermediate support 32 is a latching means 36. A portion 38 of the latching means is within the cylinder and a portion 40 extends through an aperture 42 in the cylinder.

The latching means 36 comprises a cantable washer 44 slidably mounted on the piston rod within the cylinder between the end cap 28 and the intermediate support 32 as illustrated in FIGS. 3, 4 and 5. The end cap 28 has a contact surface 46 oriented so that as the door is opened and the rod extends from the cylinder, the cantable washer 44 is carried by the rod into contact with the contact surface 46 on the end cap 28, and the washer slides in a substantially perpendicular orientation on the rod without substantial canting as illustrated in FIG. 5. The intermediate support 32 has a contact surface 48 oriented so that as the door is closed and the rod retracts into the cylinder, the cantable washer is carried by the rod to contact the contact surface 48 on the intermediate support 32 and the washer slides in a substantially perpendicular orientation on the rod without substantial canting, as illustrated in FIG. 4. The latching means 36 further comprises a positionable support means 50 fixed in the cylinder 12 against longitudinal movement towards the attachable end 16 of the cylinder. The positionable support means 50, as shown in FIG. 5, is positionable, when latching is desired, into the cylinder between the washer 44 and the intermediate support 32 so that as the piston rod begins to retract into the cylinder carrying the washer, the washer eccentrically contacts the positionable support means, cants, grasps, and arrests the rod from further retraction into the cylinder, as illustrated in FIG. 3. The positionable support means 50 is positionable to avoid canting and rod-arresting contact with the washer when latching is not desired, as illustrated in FIGS. 4 and 5.

The latching means 36 may further comprise support maintaining means 52 for maintaining the positionable support means 50 in position for canting and rod-arresting contact with the cantable washer when latching is desired and for maintaining the positionable support means 50 in position to avoid canting and rod-arresting contact with the cantable washer when latching is not desired. Such latching means 36 and support maintaining means 52 is employed in an embodiment of the invention illustrated in FIG. 6, wherein the positionable support means 50 comprises an elongated cylindrical pin 54 slidably retained in a bore 56 in a boss 58 on the cylinder 12. The pin 54 has on one end 60 outside of the cylinder a button 62 which by contact with the boss 58 limits movement of the pin into the cylinder. The pin has on its other end 64 inside the cylinder an enlarged head 66 which by contact with a shoulder 70 in a counter bore 71 in the boss 58 limits movement of the pin out of the cylinder. The maintaining means 52 comprises a resiliently deformable ring 72 trapped by the pin in a groove 74 in the boss bore. The maintaining means 52 may further comprise a groove 76 in the pin for partial retention of the resiliently deformable ring at a limit of movement of the pin into the cylinder, and a groove 78 in the pin for partial retention of the resiliently deformable ring at a limit of movement of the pin out of the cylinder. The ring 72 may be of elastomeric material or a coiled spring.

Figure 8:
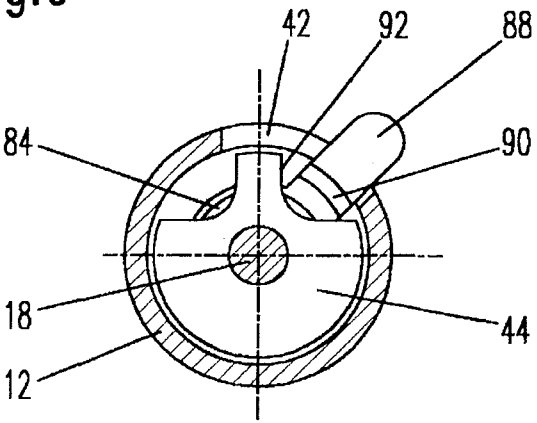
FIG. 8 is view taken along the line 8—8 of FIG. 7 illustrating the embodiment in unlatched position.
Figure 7:
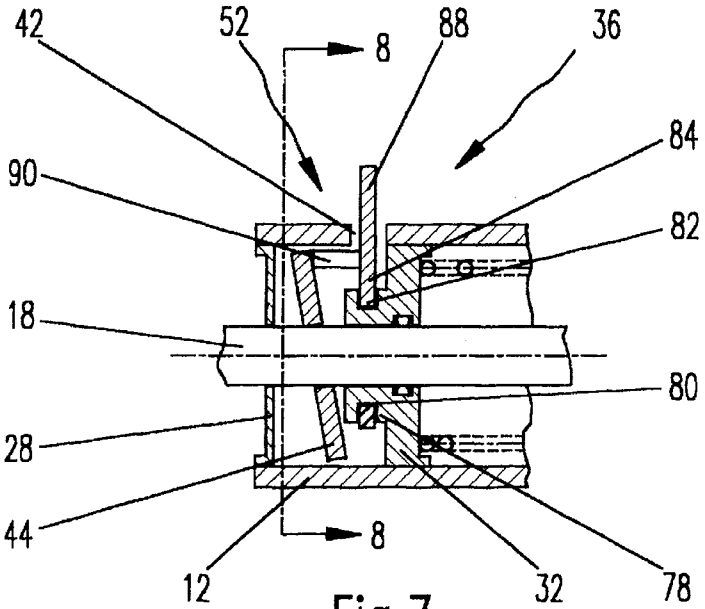
FIG. 7 is a longitudinal cross-sectional view illustrating, in latched position, another embodiment of the invention employing a lever for latching and unlatching.

The latching means 36 with support maintaining means 52 is also employed in another embodiment of the invention illustrated in FIGS. 7 and 8, wherein the intermediate support 32 has a cylindrical boss 78 having a circular groove 80 rotably retaining the inner circumference 82 of an annular disk 84. The disk has an arm 88 extending through a slot 42 in the cylinder 12 for rotation of the disk. The disk also has a tooth 90 projecting towards the end cap 28 for canting, rod-arresting contact with the cantable washer 44 when latching is desired. The washer has a cutout 92 to avoid contact with the tooth 90 when the disk 84 is rotated by a user to align the tooth 90 with the cutout 92 when latching is not desired. The washer may have additional cutouts to position its center of gravity below its geometric center so that the washer will tend to remain with its cutout 92 in a fixed angular position.

Figure 9:
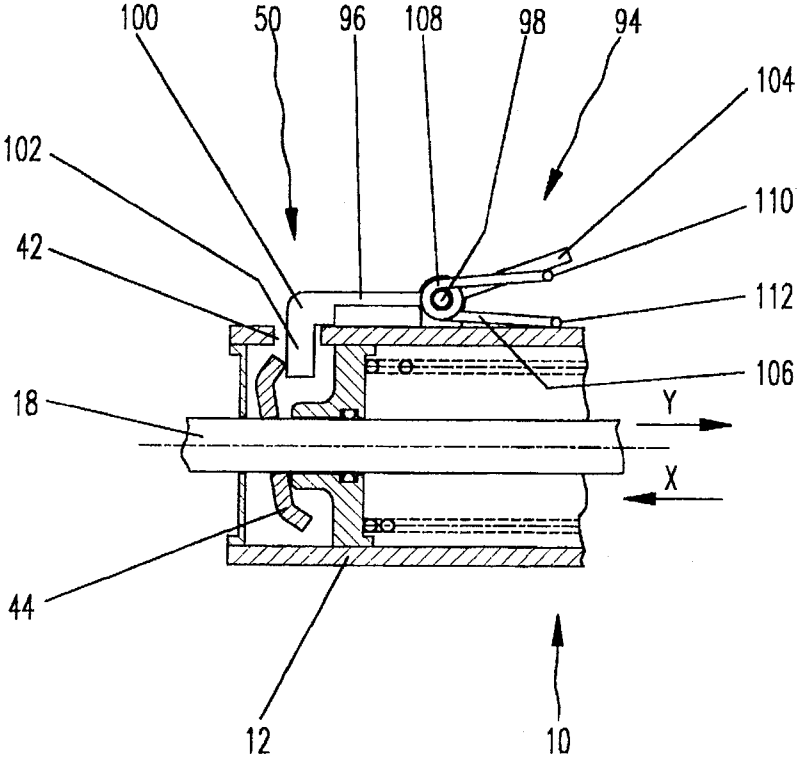
FIG. 9 is a longitudinal cross-sectional view illustrating, in latched position, another embodiment of the invention employing a lever for latching and unlatching.

The door closer 10 may include support biasing means 94 for biasing the positionable support means 50 towards a position so that as the rod begins to retract into the cylinder, the cantable washer 44 contacts the positionable support means 50, cants and arrests the rod 18. Such support biasing means 94 is employed in another embodiment of the invention, as illustrated in FIG. 9, wherein the positionable support means 50 comprises a lever 96 pivoted on an axle 98 supported from the cylinder 12. The lever 96 has an end 100 with a projecting arm 102. The biasing means 94 biases the lever 96 to a position where the arm 102 extends through the aperture 42 into the cylinder for canting, rod-arresting contact with the cantable washer when the rod begins to retract into the cylinder. The lever 96 has another end 104 for pushing by a user whereby the arm 102 is at least partially withdrawn from the cylinder to avoid canting, rod-arresting contact with the washer when unlatching is desired. One form of biasing means 94 in this embodiment may be a spring 106 having a coil 108 with two straight ends 110, 112 extending from the coil. The coil may be retained on the axle 98 with one spring end 110 under the lever end 104 intended for pushing by a user and another spring end 112 resting against the cylinder 12.

Figure 10:
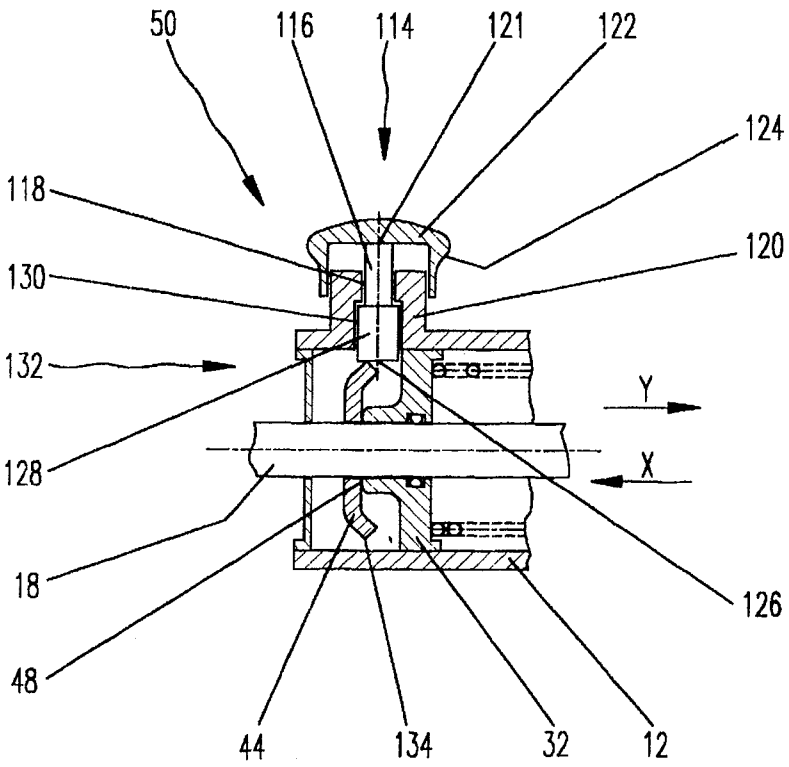
FIG. 10 is a longitudinal cross-sectional view illustrating, in unlatched position, another embodiment of the invention employing gravitational attraction as an urging means for automatic latching.

Support biasing means 114 is also employed in another embodiment of the invention illustrated in FIG. 10, wherein the positionable support means 50 comprises an elongated, cylindrical pin 116 slidably retained in a bore 118 in a boss 120 on the cylinder 12. The pin has on a first end 121 extending outside of the cylinder a button 122 of larger diameter than the pin thereby providing a limit for inward travel of the pin and a grasping surface 124 for raising the pin. The pin has towards a second end 126 extending towards the cylinder a length 128 of increased diameter capable of entering a counter bore 130 in the boss 120 and by contact with the boss 120 limiting outward travel of the pin. To provide support holding means 132 in this embodiment, the contact surface 48 on the intermediate support 32 is located so that when the pin 116 is moved by a user to an outward position and the cantable washer 44 is against the intermediate support 32, as occurs during door closing, the pin, upon release from a raised position by a user, will rest on an outer circumference 134 of the cantable washer 44. Thereafter, upon opening of the door, the pin will drop into a position where upon beginning of subsequent closing of the door, the cantable washer will contact the pin, cant, and arrest the rod of the door closer and thus the door.

The support biasing means 114 in this embodiment may comprise earthly gravitational attraction. Alternatively, the support biasing means may comprise magnetic force between a magnetized button 122 on the pin 116 and an adjacent structure, for instance, an oppositely magnetized boss 120.

Alternately, the latching means 36 may include urging means 136 urging the positionable support means 50 towards a position avoiding canting, rod-arresting contact with the cantable washer 44 and support retaining means 138 for retaining the positionable support means in canting, rod-arresting contact with the washer 44 until an extension of the rod 18 from the cylinder 12 is initiated. An initiation of rod extension allows repositioning by the urging means 136 of the positionable support means 50 to avoid canting, rod-arresting contact with the cantable washer. This allows a user to arrest a door in an open position by activating the support retaining means 136. The door then remains open until a small reopening movement is made by a user.

Figure 11:
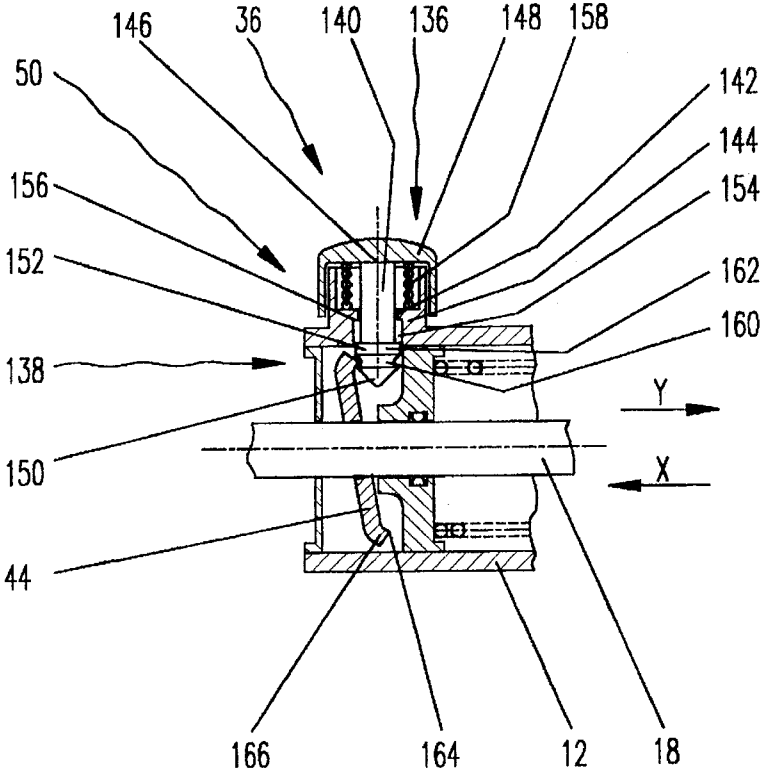
FIG. 11 is a longitudinal cross-sectional view illustrating, in latched position, another embodiment of the invention employing a spring as an urging means for automatic unlatching.

Such latching means 36 is employed in the embodiment illustrated in FIG. 11, wherein the positionable support means 50 comprises an elongated, cylindrical pin 140 slidably retained in a bore 142 in a boss 144 on the cylinder 12. The pin 140 has on a first end 146 extending outside of the cylinder a button 148 of larger diameter than the pin. On a second end 150 extending towards the cylinder, the pin has a longitudinal section 152 of larger diameter which is capable of entering a counter bore 154 in the boss 144. The pin is limited in travel outward of the cylinder by the bottom 156 of the counter bore. The urging means 136 may comprise a compressible spring 158 around the pin trapped between the button and the boss. The support retaining means 138 comprises a cavity 160 in a lateral surface 162 of the pin proximate the second end 150 of the pin extending towards the cylinder and a lip 164 on the outer circumference 166 of the cantable washer 44. When the button 148 is depressed, the pin cavity 160 longitudinally aligns with the washer lip 164. When latching of a door in an open position is desired by a user, depressing the button on the pin and allowing the door to close a little allows the rod to retract slightly and carry the washer so that the washer lip enters the cavity in the pin. Such contact of the washer with the pin cants the washer and arrests the rod and thus the door. The pin remains in this restrained position until an initiation of reextension of the rod from the cylinder carries the washer and lip out of the cavity on the pin. The initiation of rod reextension is accomplished by a user by a slight opening movement of the door. Then, the door can close.

Figure 12:
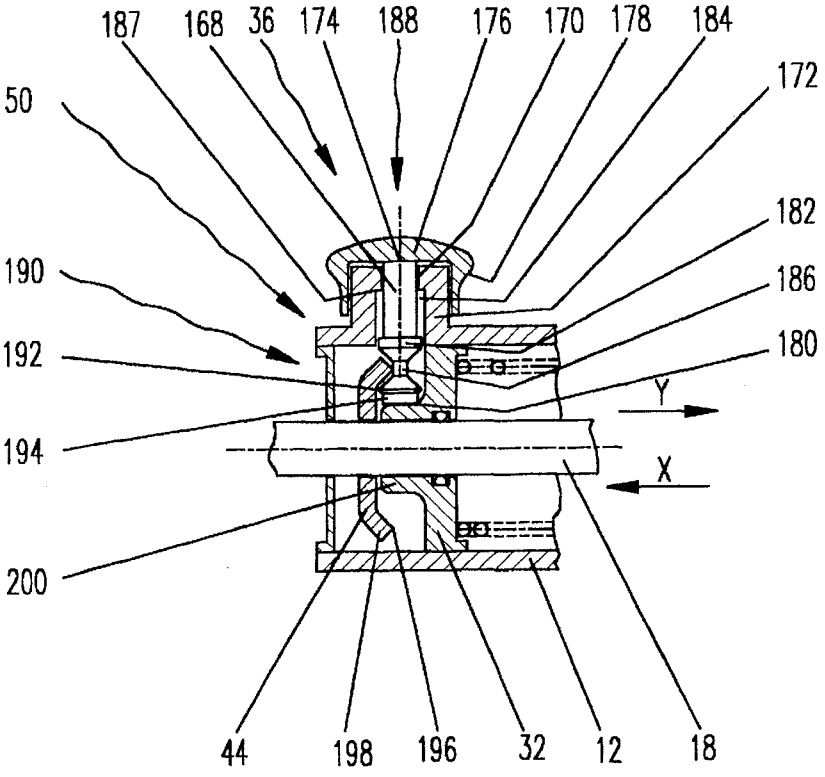
FIG. 12 is a longitudinal cross-sectional view illustrating, in unlatched position, another embodiment of the invention employing gravitational attraction as an urging means for automatic unlatching.

The latter latching means 36 is also employed in another embodiment of the invention illustrated in FIG. 12, wherein the positionable support means 50 comprises an elongated, cylindrical pin 168 slidably retained in a bore 170 in a boss 172 on the cylinder 12. The pin has on a first end 174 extending outside of the cylinder a button 176 of larger diameter than the pin, thus providing a grasping surface 178 for raising the pin. The pin has on a second end 180 extending towards the cylinder a first pin shoulder 182 capable of entering a counter bore 184 in the boss, and by contact with the bottom 187 of the counter bore limiting outward travel of the pin from the cylinder. The pin also has beyond the first shoulder 182 towards the second end 180 a length of reduced diameter 186. The support urging means 188 comprises earthly gravitational attraction on the pin. Optionally, the support urging means may include a compressible spring around the pin trapped between the first shoulder on the pin and the end of the boss counter bore. The support retaining means 190 comprises a second pin shoulder 192 on a lateral surface 194 of larger diameter on the pin beyond the length of reduced diameter 186 towards the second pin end 180 and a lip 196 at an outer circumference 198 of a cantable washer 44. When latching of an opened door by a user is desired, raising the button 176 on the pin 168 and allowing the door to close slightly causes initiation of retraction of the rod 18 which positions the washer lip 196 under the second pin shoulder 192 thereby holding the pin from dropping, canting the washer and arresting the rod from retraction into the cylinder. Subsequently, a slight opening movement of the door by a user causes an initiation of extension of the rod from the cylinder which carries the washer and lip out of contact with the shoulder allowing the pin to drop until the second pin end 180 contacts and is supported by an extension 200 on the intermediate support 32 thereby longitudinally aligning the washer lip 196 with the length 186 of reduced diameter on the pin. This avoids canting, rod-arresting contact of the washer and pin and allows retraction of the rod and thus closure of the door.

Certain preferred embodiments of the present invention having been described by way of example, it is apparent that various changes may be made in the form, construction and arrangement of the parts described without departing from the spirit and scope of the invention. The described embodiments are therefore to be considered as illustrative and not restrictive, the scope of the invention being indicated by the appended claims rather than by the foregoing description, and all changes which come within the meaning and range of equivalency of the appended claims are therefore intended to be embraced therein.

What is claimed is:

1. A door closer comprising:

(a) a cylinder having a free end and an attachable end attachable to a door or door frame;

(b) a piston rod having a piston end retaining a piston and an attachable end attachable to a door frame or door, said piston rod and said piston being contained in said cylinder with said attachable end of said piston rod extending out of said cylinder free end and slidably displaceable within said cylinder from a maximum retracted position in said cylinder to a maximum extended position;

(c) piston urging means within said cylinder urging said piston to the maximum retracted position, said urging means being placed within said cylinder, in between said free end of said cylinder and said piston and pushing, directly or through means, against said piston;

(d) an end cap fixed on said cylinder proximate said free end of said cylinder, said end cap having a passage for said piston rod;

(e) an intermediate support fixed in said cylinder longitudinally spaced from said end cap in between said end cap and said piston urging means, said intermediate support having a passage for said piston rod; and (f) latching means, a portion thereof within said cylinder between said end cap and said intermediate support, and another portion thereof extending through an aperture in said cylinder.

2. The door closer as in claim 1 wherein said latching means comprises:

(a) a cantable washer slidably mounted on said piston rod within said cylinder between said end cap and said intermediate support;

(b) first contact surface on said end cap, said first contact surface oriented so that as said rod extends from said cylinder, said cantable washer contacts said first contact surface and allows the free passage of said piston rod by being maintained in a position which is essentially perpendicular on said piston rod;

(c) a second contact surface on said intermediate support, said second contact surface oriented so that as said piston rod retracts into said cylinder, said cantable washer contacts said second contact surface and allows the free passage of said piston rod by being maintained by said second contact surface in a position which is essentially perpendicular to said piston rod and (d) positionable support means which is attached to said cylinder such that, relative to said cylinder, it cannot be moved in longitudinal direction but, it can be moved such that, when latching is desired, said positionable support means is positioned in said cylinder in between said cantable washer and said intermediate support so that as said piston rod retracts into said cylinder carrying said cantable washer, said cantable washer eccentrically contacts said positionable support means, cants, grasps, and arrests said piston rod from further retraction into said cylinder, and, when latching is not desired, said positionable support means is moved to a position in which canting and rod-arresting contact with said cantable washer is prevented.

3. The door closer as in claim 2 wherein said latching means further comprises maintaining means for maintaining said positionable support means in position for canting and rod-arresting contact with said cantable washer when latching is desired, and for maintaining said positionable support means in position to avoid canting and rod-arresting contact with said cantable washer when latching is not desired.

4. The door closer as in claim 3 wherein said positionable support means comprises a pin slidably retained in a bore in a boss on said cylinder, said pin having on one end outside of said cylinder a button which by contact with said boss limits movement of said pin into said cylinder, said pin having on another end inside said cylinder a section of enlarged size which by contact with a shoulder in a counter bore in said boss limits movement of said pin out of said cylinder, and wherein, latching is enabled by pushing said pin towards said cylinder, position in which said cantable washer eccentrically contacts said pin as said piston rod retracts into said cylinder, and wherein said maintaining means comprises a resiliently deformable ring trapped by said pin in a groove in said boss bore.

5. The door closer as in claim 4 wherein said maintaining means further comprises a groove in said pin for partial retention of said resiliently deformable ring at a limit of movement of said pin into said cylinder, and a groove in said pin for partial retention of said resiliently deformable ring at a limit of movement of said pin out of said cylinder.

6. The door closer as in claim 2 wherein said positionable support means comprise a cylindrical boss on said intermediate support, on the side of said intermediate support oriented towards said end cap, said cylindrical boss having a circular groove rotably retaining the inner circumference of an annular disk having an arm extending through a slot in said cylinder for rotation of said disk, said disk having a tooth projecting towards said end cap, said tooth for canting, rod-arresting contact with said cantable washer when latching is desired, said cantable washer having at least a cutout to avoid contact with said tooth when said disk is rotated by a user to align said tooth with said cutout when latching is not desired.

7. The door closer as in claim 2 further comprising support biasing means for biasing said positionable support means towards a position so that as said piston rod begins to retract into said cylinder, said cantable washer contacts said positionable support means, cants and arrests said rod.

8. The door closer as in claim 7 wherein said positionable support means comprises a lever pivoted on an axle supported from said cylinder, said lever having an end with a projecting arm, said support biasing means biasing said lever to a position where said arm enters through an aperture into said cylinder for canting, rod-arresting contact with said cantable washer when said piston rod begins to retract into said cylinder, said lever having an end for pushing by a user whereby said arm is at least partially withdrawn from said cylinder to avoid contact with said cantable washer when unlatching is desired.

9. The door closer as in claim 7 wherein said positionable support means comprises a pin slidably retained in a holding bore in a boss on said cylinder, said support biasing means biasing said pin towards an inserted position in said cylinder, said pin having on a first end extending outside of said cylinder a button of larger size than said pin thereby providing a limit for inward travel of said pin and a grasping surface for raising said pin, said pin having towards a second end extending towards said cylinder a section of increased size capable of entering a counter bore in said boss and by contact with said boss limiting outward travel of said pin; and wherein said holding bore and said second contact surface on said intermediate support are located so that when said pin is moved by a user to an outward position and said cantable washer is against said second contact surface, said pin upon release by a user will rest on an outer circumference of said cantable washer.

10. The door closer as in claim 9 wherein said support biasing means is chosen from the group consisting of a compressible spring; earthly gravitational attraction on said pin; and magnetic force between said pin and an adjacent structure.

11. The door closer as in claim 2 wherein said latching means further comprises support urging means urging said positionable support means towards a position avoiding canting, rod-arresting contact with said cantable washer and support retaining means for retaining said positionable support means in canting, rod-arresting contact with said cantable washer until initiation of reextension of said piston rod from said cylinder occurs which allows repositioning by said support urging means of said positionable support means to avoid canting, rod-arresting contact with said cantable washer.

12. The door closer as in claim 11 wherein:

said positionable support means comprises a pin slidably retained in a bore in a boss on said cylinder, said pin having on a first end extending outside of said cylinder a button of larger size than said pin; said pin having on a second end extending towards the cylinder a section of larger size which upon entering a counter bore in the boss is limited in travel outward of said cylinder by said counter bore; and said support retaining means comprises a cavity in a lateral surface of said pin proximate said second end of said pin, and a lip at an outer circumference of said cantable washer so that when latching is desired, depressing said button on said pin positions said cavity on said pin in longitudinal alignment with said lip on said cantable washer, and initiation of retraction of said piston rod into said cylinder carries said cantable washer and moves said lip into said cavity on said pin thereby restraining said pin from withdrawal by said support urging means until an initiation of reextension of said piston rod from said cylinder carries said cantable washer and lip out of said cavity in said pin.

13. The door closer as in claim 11 wherein:

said positionable support means comprises a pin slidably retained in a bore in a boss on said cylinder, said pin having on a first end extending outside of said cylinder a button of larger size than said pin thereby providing a grasping surface for raising said pin, said pin having towards a second end extending towards said cylinder a first pin shoulder capable of entering a counter bore in said boss and by contact with said counter bore limiting upward travel of said pin, and said pin having beyond said first shoulder towards said second end a length of reduced cross-sectional size;

said support urging means comprises earthly gravitational attraction on said pin; and said support retaining means comprises a second pin shoulder on a lateral surface of increased size on said pin beyond said length of reduced cross-sectional size towards said second pin end and a lip at an outer circumference of said cantable washer, so that when latching of an opened door is desired by a user, raising said button on said pin and allowing initiation of retraction of said piston rod into said cylinder positions said lip under said second pin shoulder thus holding said pin from dropping and in canting, rod-arresting contact with said washer, until a subsequent initiation of extension of said piston rod from said cylinder by a user carries said washer and lip out of contact with said second pin shoulder allowing said pin to drop in a position longitudinally aligning said lip with said length of reduced cross-sectional size on said pin, thereby avoiding canting, rod-arresting contact of said cantable washer with said pin, and thereby allowing retraction of said piston rod.

* * * * *